United States Patent [19]

Jones

[11] 4,072,265

[45] Feb. 7, 1978

[54] SIGNALING DEVICE FOR MAILBOXES

[76] Inventor: Richard S. Jones, 125 Markboro Drive, Greenville, S.C. 29605

[21] Appl. No.: 794,381

[22] Filed: May 6, 1977

[51] Int. Cl.[2] ..... A47G 29/12

[52] U.S. Cl. ..... 232/35

[58] Field of Search ..... 232/35, 34

[56] References Cited

U.S. PATENT DOCUMENTS

| | | | |
|---|---|---|---|
| 1,562,536 | 11/1925 | Berg | 232/34 |
| 2,613,031 | 10/1952 | Joyce | 232/35 |
| 2,853,230 | 9/1958 | Hays | 232/35 |
| 3,606,141 | 9/1971 | Taylor | 232/35 |
| 3,675,845 | 7/1972 | Scheerer | 232/35 |
| 3,722,460 | 3/1973 | James | 232/35 |
| 3,794,240 | 2/1974 | Myers | 232/35 |

*Primary Examiner*—Francis K. Zugel

*Attorney, Agent, or Firm*—Bailey, Dority & Flint

[57] ABSTRACT

A signaling device is illustrated employing a flag supported adjacent a bottom edge of the mailbox which is pivotable downwardly out of retracted position by the act of the postman opening the mailbox. The flag device is positively operated and is positionable for maximum exposure in selectable positions.

3 Claims, 4 Drawing Figures

SIGNALING DEVICE FOR MAILBOXES

BACKGROUND OF THE INVENTION

Several devices have been contemplated for signaling that a mail delivery has occurred responsive to the postman's act of opening the mailbox, as for example, the disclosures of U.S. Letters Pat. Nos. 2,853,230 and 3,675,845. In the disclosure of the former there are no spring biasing means which permit positive operation as contemplated by the invention hereof and there are no selectable positioning means. The flag of the former device is carried for maximum exposure from one direction only, whereas it is an object of the present invention to selectably position the flag for maximum exposure from any of a number of directions. The disclosure of the last mentioned patent requires installation of a relatively complex device interiorly of the mailbox, limiting the usefulness thereof and providing maximum signaling from a single direction.

Accordingly, it is an important object of this invention to provide a positively positionable flag device which is of simple construction, capable of signaling that a mail delivery has occurred responsive to the act of the postman in opening the mailbox.

Another important object of the invention is the provision of multiple positioning means so that the flag may be more effective in signaling from any of a number of directions.

Still another object of the invention is the provision of catch retaining means for normally maintaining the flag in restricted position facilitated by a camming surface for receiving the flag into the retracted position.

BRIEF DESCRIPTION OF THE INVENTION

It has been found that a signaling device may be provided for rural mailboxes responsive to the act of opening the mailbox by utilizing a spring biased plunger carried adjacent a lower edge of the mailbox carrying a catch member for maintaining a flag in retracted position beneath the mailbox but which is releasable by a lower edge of the closure door of the mailbox with the plunger permitting the flag to pivot downwardly in any of a number of selected positions.

BRIEF DESCRIPTION OF THE DRAWING

The construction designed to carry out the invention will be hereinafter described, together with other features hereof.

The invention will be more easily understood from a reading of the following specification and by reference to the accompanying drawing forming a part thereof, wherein an example of the invention is shown and wherein.

DESCRIPTION OF A PREFERRED EMBODIMENT

Figure 1:
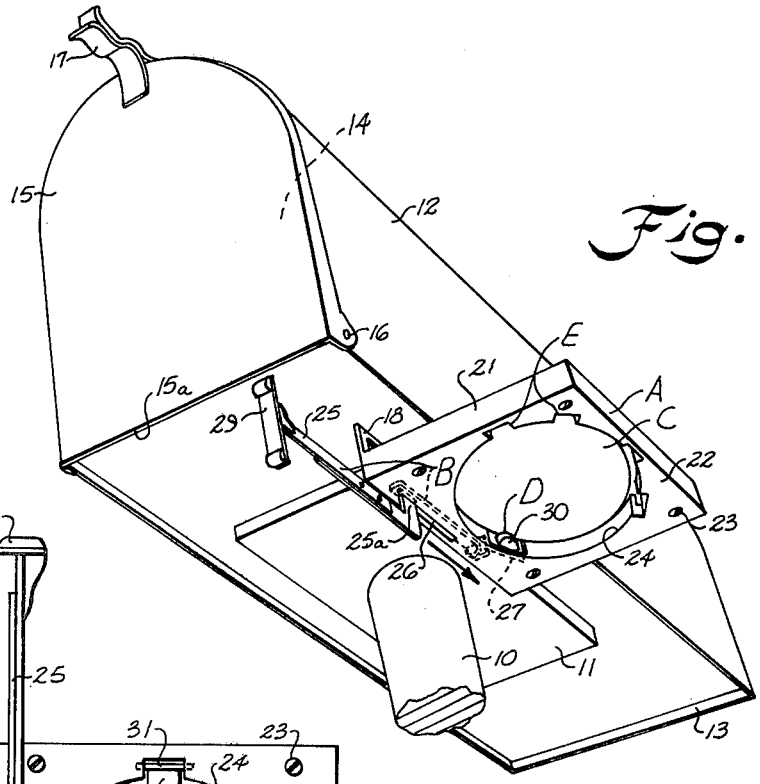
FIG. 1 is a perspective view looking upwardly from a side of the mailbox adjacent the delivery end illustrating a signaling device constructed in accordance with the present invention.

A signaling device is illustrated for use with free standing rural mailboxes, having an open-ended mail receiving compartment and a closure therefor pivoted adjacent a lower end thereof adjacent a lower edge of said compartment for downward pivotal movement of the closure exposing the open end for reception of mail when opened by a postman.

A housing A is carried adjacent a lower intermediate edge portion of the mail receiving compartment. A plunger B is carried by the housing spring biased rearwardly toward the closure having an operator normally adjacent a lower edge of said closure but movable forwardly responsive to downward movement of said closure. A flag C is normally carried by the housing in retracted position but pivotable downwardly adjacent one edge thereof. A catch member D is carried by the plunger engagable with the flag maintaining the flag in retracted position when said operator is normally positioned adjacent a lower edge of the closure but releasable therefrom when the operator is moved forwardly. Thus, the flag pivots downwardly into signaling position upon opening of the closure by the postman. A plurality of circumferentially spaced pivotal positions E are provided for selectively carrying the flag for effective display positioning. The catch member carries a camming surface facilitating reception of the flag into retracted position.

Referring more particularly to the drawing, a rural mailbox is illustrated which is free standing being carried on a post 10 provided with a base support 11 to which the mail receiving compartment 12 is suitably attached. The mail receiving compartment 12 has a lower flange 13 extending thereabout and has an open end 14 for the reception of mail which is normally covered by a closure member 15 which is pivoted as at 16 adjacent a lower edge for downward movement. A catch 17 is illustrated maintaining the closure in position covering the open end 14 of the mailbox. The housing A is illustrated as including a bracket 18 having a slot 19 therein for carrying suitable fastening means such as screws 20 for attachment of the housing to the base member 11. If desired, the housing A may be secured to the depending flange 13 which extends about the lower edge portions of the mailbox. Thus, the housing A is carried adjacent an intermediate portion of the mailbox and projects outwardly of a lower edge of the mailbox. The housing includes side frame members 21, as well as a removable lower cover member 22 attachable at a lower portion of the sides by suitable fastening means 23. The cover 22 has an annular opening 24 therein for receiving the flag within the housing when in the retracted position.

Figure 2:
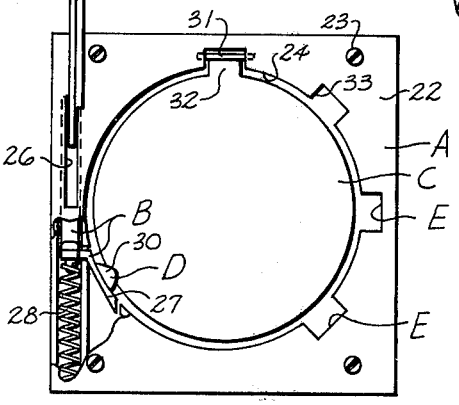
FIG. 2 is an enlarged bottom plan view, with parts broken away, looking upwardly toward the signaling device.

The plunger is best illustrated in FIGS. 1 and 2 in retracted position wherein an arm 25 thereof extends upwardly as at **25*a* into a longitudinal slot 26 within the lower cover member 22 for guiding the plunger when moved forwardly in the direction of the arrow. The plunger has a laterally inclined arm 27 which is carried by the portion 25*a* within the housing A. A compression spring 28 is provided within the housing for normally spring biasing the plunger B rearwardly so that a vertical operator 29 may be positioned for engagement by a depending edge 15*a* of the closure 15 carried below the pivot 16**.

Figure 3:
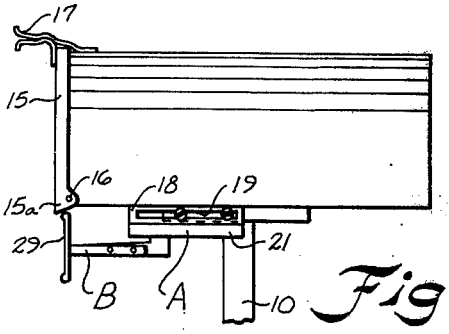
FIG. 3 is a side elevation at a reduced scale illustrating the mailbox with the signaling device in retracted position.
Figure 4:
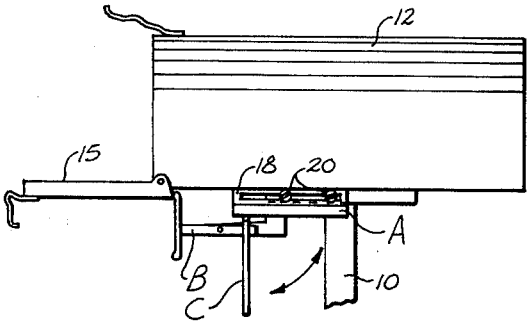
FIG. 4 is a side elevation similar to FIG. 3 but illustrating the signaling device in signaling position.

The flag C is illustrated in the form of a disk which may be colored red or any other desirable bright color to aid in positioning maximum facability. The flag C is restricted in retracted position by the catch member D which is carried by the plunger. The catch member D has a camming surface 30 which is best seen in FIGS. 1 and 2 to facilitate reception of the flag into the retracted position illustrated in FIGS. 1, 2 and 3. To facilitate lateral displacement between the flag member C and the catch member D, responsive to camming action afforded by the surface 30 there is some play between the parts permitted by the guide slot 26 and the pivotal mounting of the flag C. It will be observed that the pivotal mounting is provided by a horizontal pin 31 carried by a tab portion 32 extending outwardly of the flag C. The pin 31 is received within spaced pivotable positions E defined by notches 33 for receiving the horizontal pin 31. A number of circumferentially spaced pins are provided in the pivotal portions E. Thus, when assembling the signaling device the pivot pin is placed at a selected position E prior to confining same therein by placement of the lower cover and securing same in position by fastening means 23. Therefore, the remotely positioned mailbox which may be facing in any number of directions relative to the dwelling from which the signaling device is to be observed may accommodate the flag in a position providing best exposure thereof.

While a preferred embodiment of the invention has been described using specific terms, such description is for illustrative purposes only, and it is to be understood that changes and variations may be made without departing from the spirit or scope of the following claims.

What is claimed is:

1. A signaling device for use with free standing rural mailboxes, having an open-ended mail receiving compartment and a closure therefor pivoted adjacent a lower end thereof adjacent a lower edge of said compartment for downward pivotal movement of said closure exposing said open end for reception of mail when opened by a postman comprising:

a housing carried adjacent a lower intermediate edge portion of said mail receiving compartment;

a plunger slidably carried by said housing spring biased rearwardly toward said closure having an operator normally adjacent a lower edge of said closure but movable forwardly responsive to downward movement of said closure;

a flag normally carried by said housing in retracted position but pivotable downwardly adjacent one edge thereof; and a catch member carried by said plunger engagable with said flag maintaining the flag in retracted position when said operator is normally positioned adjacent a lower edge of said closure but releasable therefrom when said operator is moved forwardly;

whereby the flag pivots downwardly into signaling position upon opening of said closure by the postman.

2. The structure set forth in claim 1 including;

a plurality of circumferentially spaced pivotal positions for selectively carrying said flag for selective display positioning.

3. The structure set forth in claim 2 wherein said catch member carries a camming surface facilitating reception of said flag into retracted position.

* * * * *